US007311587B2

(12) United States Patent
Cheng

(10) Patent No.: US 7,311,587 B2
(45) Date of Patent: Dec. 25, 2007

(54) POLISHING MACHINE WITH A BRAKE DEVICE

(76) Inventor: Ming-Ta Cheng, No. 38-11, Lin 10, Zhongzheng Li, Yuanli Chen, Miaoli Hsien (TW)

( * ) Notice: Subject to any disclaimer, the term of this patent is extended or adjusted under 35 U.S.C. 154(b) by 183 days.

(21) Appl. No.: 11/236,395

(22) Filed: Sep. 27, 2005

(65) Prior Publication Data

US 2007/0072525 A1 Mar. 29, 2007

(51) Int. Cl.
*B24B 23/04* (2006.01)

(52) U.S. Cl. ..... 451/357; 451/354; 451/456

(58) Field of Classification Search ..... 451/344, 451/354, 356, 357, 358, 359, 451, 456
See application file for complete search history.

(56) References Cited

U.S. PATENT DOCUMENTS 5,317,838 A * 6/1994 Bourner ..... 451/294
5,384,984 A * 1/1995 Smith ..... 451/357
5,392,568 A * 2/1995 Howard et al. ..... 451/357
5,807,169 A * 9/1998 Martin et al. ..... 451/357
5,813,903 A * 9/1998 Amano et al. ..... 451/294
6,132,300 A * 10/2000 Martin ..... 451/357
6,264,539 B1 * 7/2001 Chen ..... 451/359
6,343,982 B1 * 2/2002 Sun ..... 451/357
6,758,731 B2 * 7/2004 Dutterer et al. ..... 451/357
6,780,094 B2 * 8/2004 Walker ..... 451/356

* cited by examiner

*Primary Examiner*—Timothy V. Eley
(74) *Attorney, Agent, or Firm*—William E. Pelton, Esq.; Cooper & Dunham LLP

(57) ABSTRACT

A polishing machine includes a body. A driving motor is installed in the body. The driving motor has an eccentric shaft mounted at a bottom of the motor, and a polishing wheel connector mounted under the eccentric shaft. A dust shield is mounted on the body and outside the driving motor. Multiple brake units are mounted at a bottom of the dust shield. A polishing wheel is mounted under the dust shield and fastened on the polishing wheel connector by a threaded pin formed at a center of the polishing wheel. The polishing wheel is in contact with the multiple brake units.

6 Claims, 6 Drawing Sheets

POLISHING MACHINE WITH A BRAKE DEVICE

BACKGROUND OF THE INVENTION

1. Field of the Invention

The present invention relates to a polishing machine, and more particularly to a polishing machine with a brake device that can quickly brake a spinning polishing wheel.

2. Description of the Related Art

A conventional polishing machine includes a compressed air motor to drive an eccentric shaft. A polishing wheel connector is provided under the eccentric shaft, and a polishing wheel is mounted on the polishing wheel connector.

In use, the polishing wheel is rotated to polish a work piece. However, a conventional polishing machine does not have a means to stop, or brake, the polishing wheel. Therefore, when the compressed air motor is stopped, the polishing wheel continues to rotate freely for a long time.

To quickly stop the polishing wheel, a person may touch the polishing wheel to a surface, such as the ground. However, this method may damage the polishing wheel.

Therefore, the invention provides a polishing machine to mitigate or obviate the aforementioned problems.

SUMMARY OF THE INVENTION

The main objective of the present invention is to provide a polishing machine that can quickly brake a spinning polishing wheel. To achieve the above objective, the polishing machine in accordance with the present invention comprises a body, a driving motor, a dust shield, multiple drive units and a polish wheel. The driving motor is installed in the body and has an eccentric shaft and a polishing wheel connector. The eccentric shaft is mounted at a bottom of the motor. The polishing wheel connector is mounted under the eccentric shaft. The dust shield is mounted on the body and outside the driving motor. The brake units are mounted at a bottom of the dust shield. The polishing wheel is mounted under the dust shield and is fastened to the polishing wheel connector by a threaded pin formed at a center of the polishing wheel, such that the polishing wheel contacts the multiple brake units.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
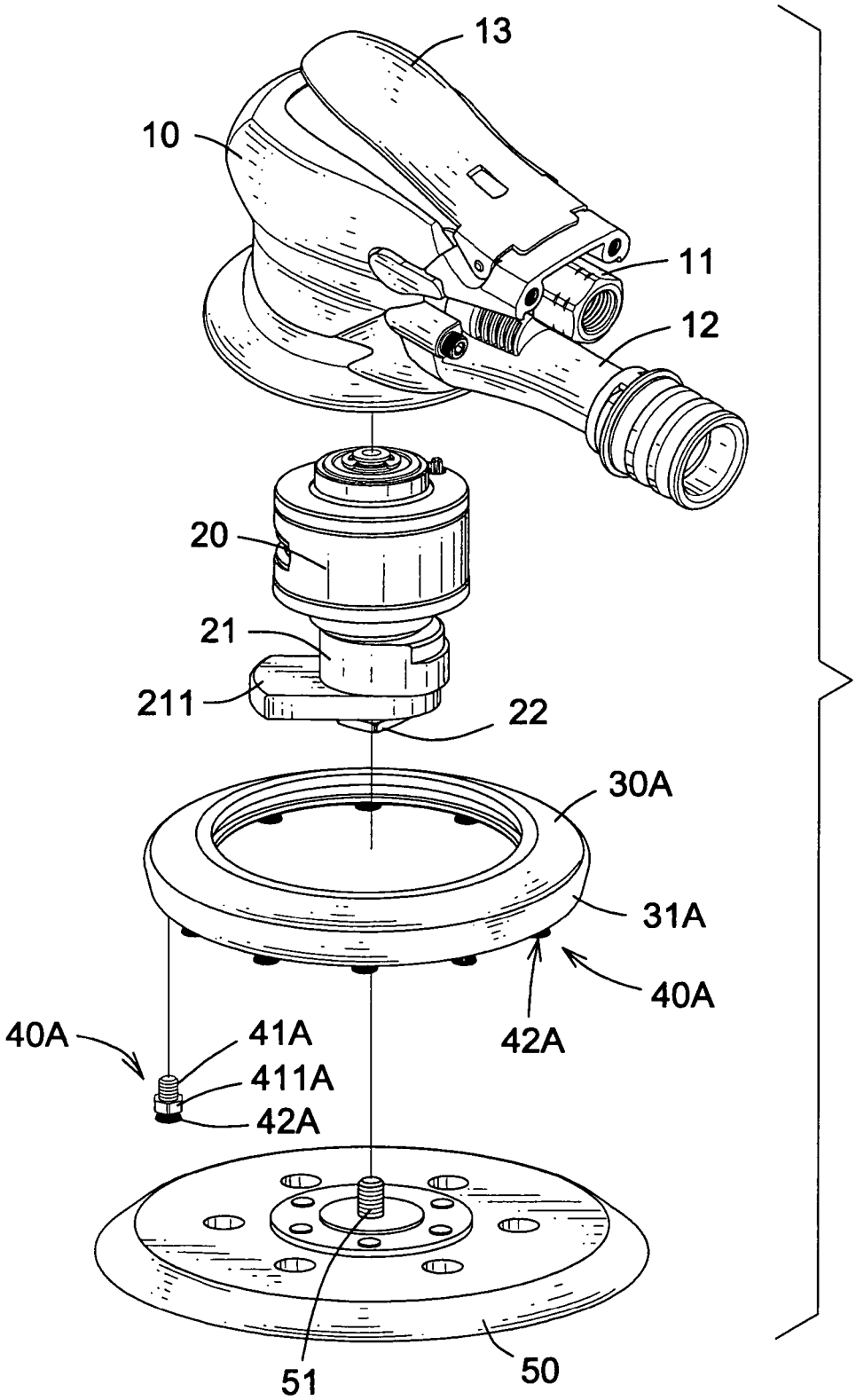
FIG. 1 is an exploded perspective view of a first embodiment of a polishing machine in accordance with the present invention.
Figure 2:
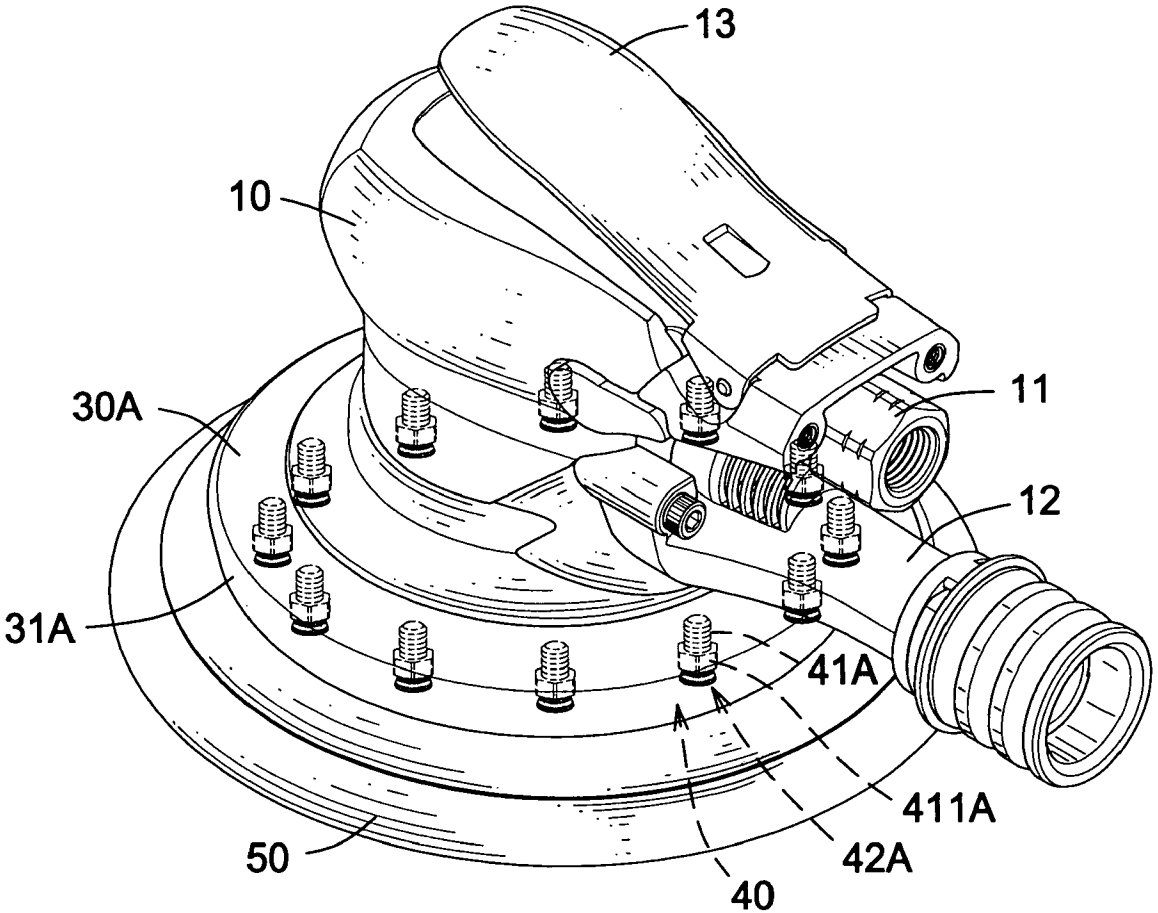
FIG. 2 is a perspective view of the polishing machine in FIG. 1.
Figure 3:
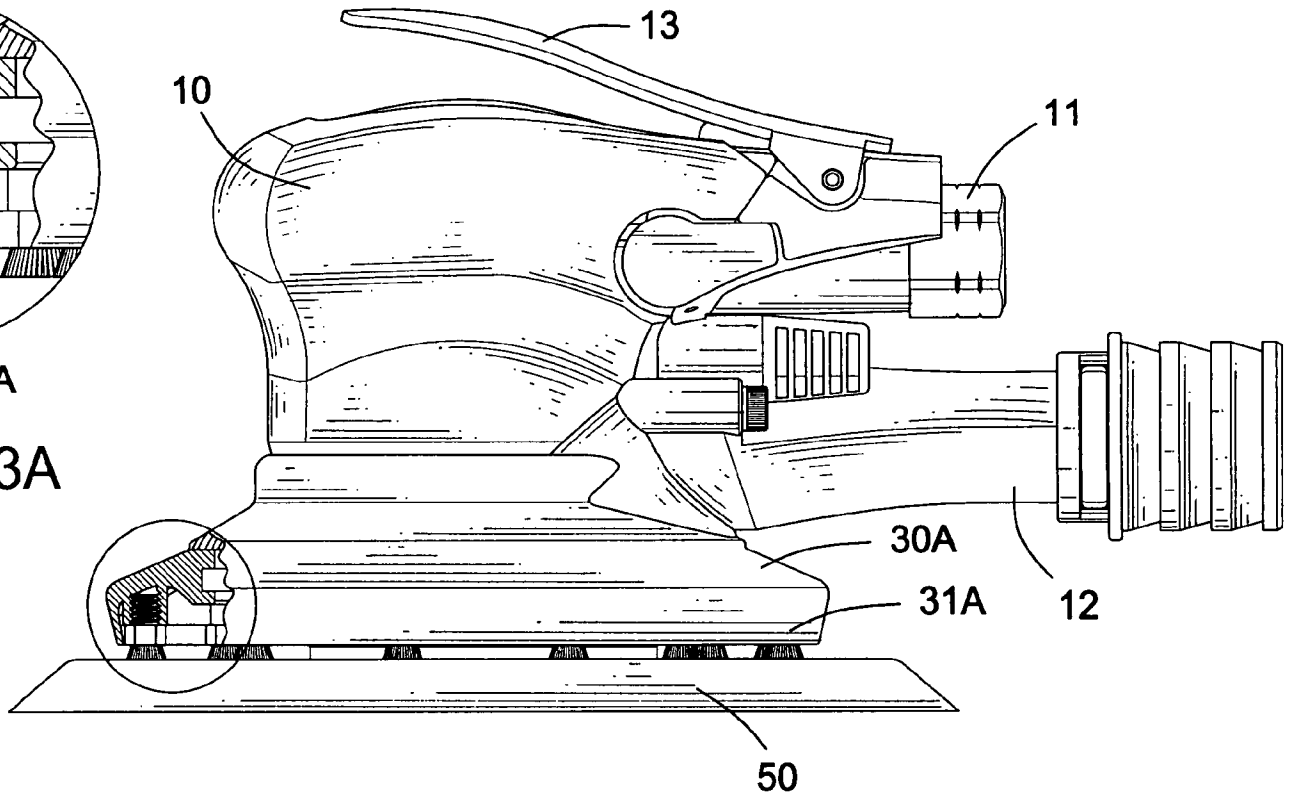
FIG. 3 is a side view of the polishing machine in FIG. 1.
Figure 3A:
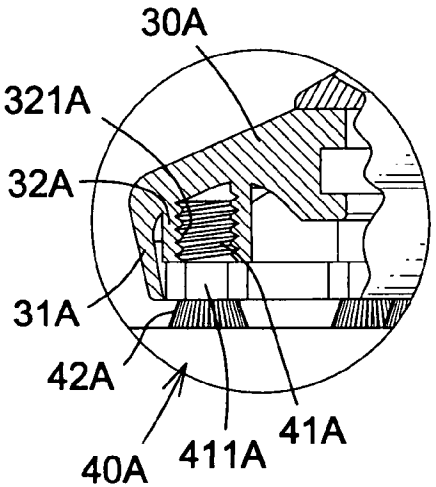
FIG. 3A is an enlarged side view in partial section of the polishing machine in FIG. 3.
Figure 4:
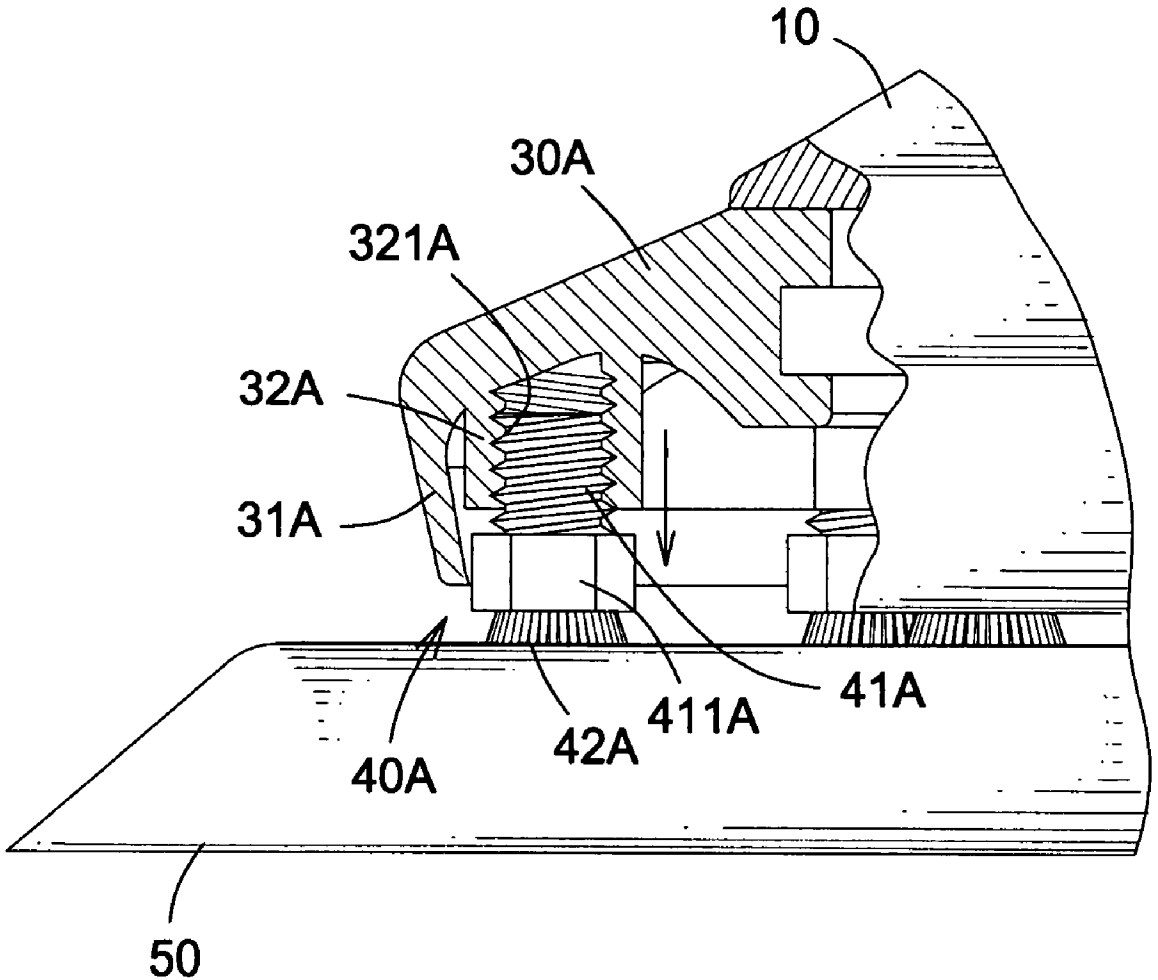
FIG. 4 is an enlarged side view in partial section of the polishing machine in FIG. 3.

With reference to FIGS. 1-4, a first embodiment of a polishing machine in accordance with the present invention is illustrated. The polishing machine includes a body (10), a driving motor (20), a dust shield (30A), brake units (40A), and a polishing wheel (50).

The body (10) has an open end defined at a bottom side thereof. An inlet valve (11) and a dust exhaust tube (12) are formed on the body (10). The dust exhaust tube (12) communicates with the open end of the body (10) to discharge dust. A trigger (13) is mounted on the body (10) to control the inlet valve (11).

The driving motor (20) is a compressed air motor installed in the body (10). The compressed air motor is driven by an air source connected thereto through the inlet valve (11). Alternatively, the driving motor (20) can also be an electric motor (not shown).

An eccentric shaft (21) is mounted on a bottom of the driving motor (20), and a counterweight (211) is mounted on the eccentric shaft (21). The counterweight (211) is formed with a rectangular shape and extends outwards from the eccentric shaft (21). A polishing wheel connector (22) is mounted under the counterweight (211).

The dust shield (30A) is formed with a skirt (31A) extending downwards and is mounted on the body (10). Multiple sleeves (32A) are evenly formed around the circumference of the skirt (31A). Each sleeve (32A) has a threaded hole (321A) defined therein.

The brake units (40A) are engaged respectively in the threaded holes (321A) of the sleeves (32A). Each brake unit (40A) has a shank (41A) with an external thread, a hexagonal head (411A) formed at a bottom of the shank (41A) and a brake pad (42A) formed under the head (411A). In this embodiment, the brake pads (42A) used are rubber brushes. In this embodiment, the polishing machine has twelve sleeves (32A) and brake units (40A).

The polishing wheel (50) is mounted under the dust shield (30A) and has a diameter larger than that of the dust shield (30A). A threaded pin (51) is formed at a center of the polishing wheel (50) and is engaged in the connector (22) to fasten the polishing wheel (50) on the connector (22). The polishing wheel (50) abuts the brake pads (42A) of the brake units (40A) to create friction between the polishing wheel (50) and the brake pads (42A).

In use, the eccentric shaft (21) is driven by the driving motor (20) to rotate the polishing wheel (50). When the motor (20) is stopped, the polishing wheel (50) rotates freely, but is braked by the friction of the brake pads (42A). Therefore, the polishing wheel (50) can be stopped quickly.

Moreover, after extended use, the brake pads (42A) may become worn down and will not touch the polishing wheel (60) to create enough friction with the polishing wheel (5). In this case, the brake units (40A) can be rotated about in the sleeves (32A) to lower the shanks (41A) so that the brake pads (42A) remain in contact with the polishing wheel (50).

Figure 5:
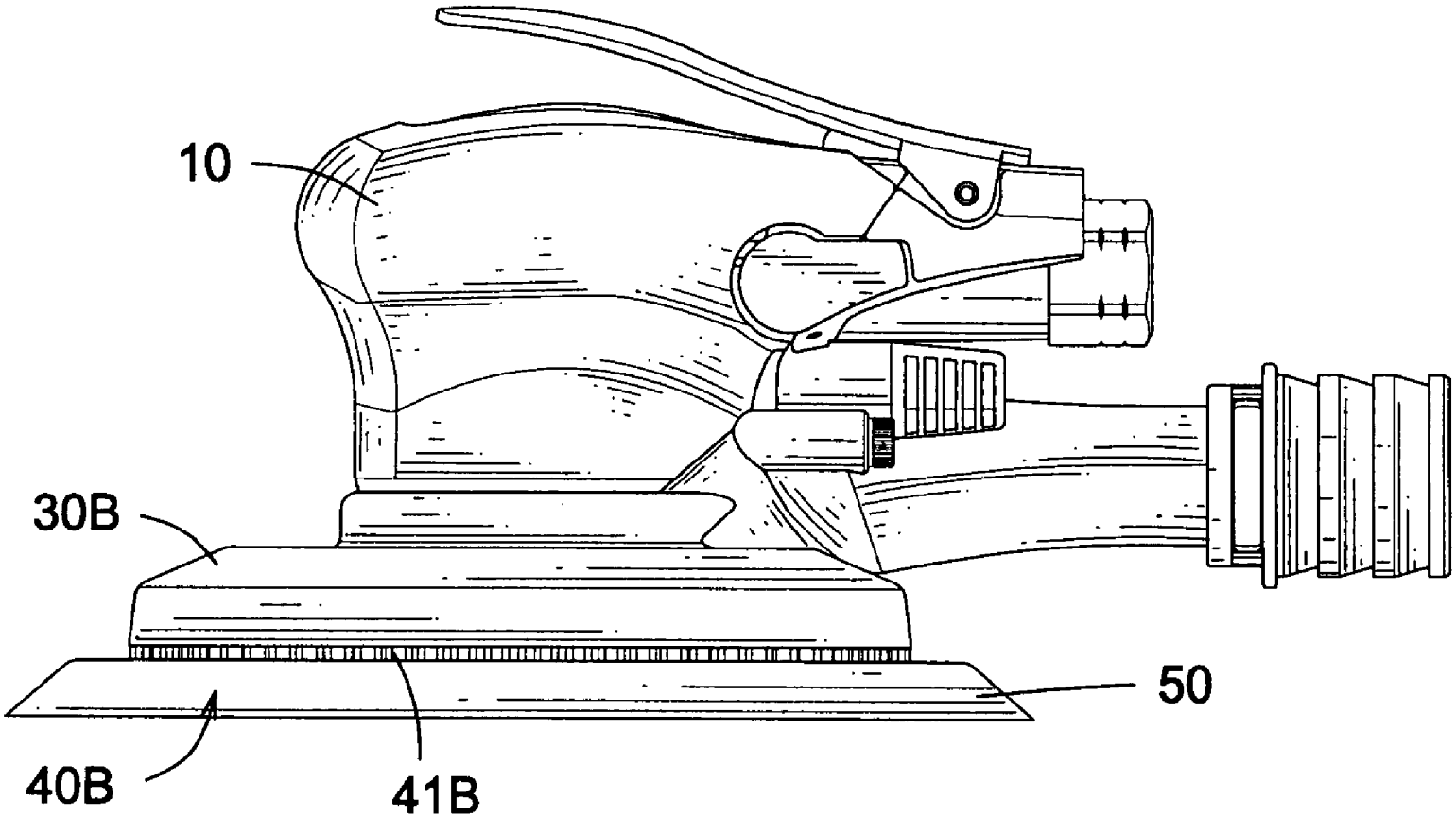
FIG. 5 is a side view of a second embodiment of the present invention.
Figure 6:
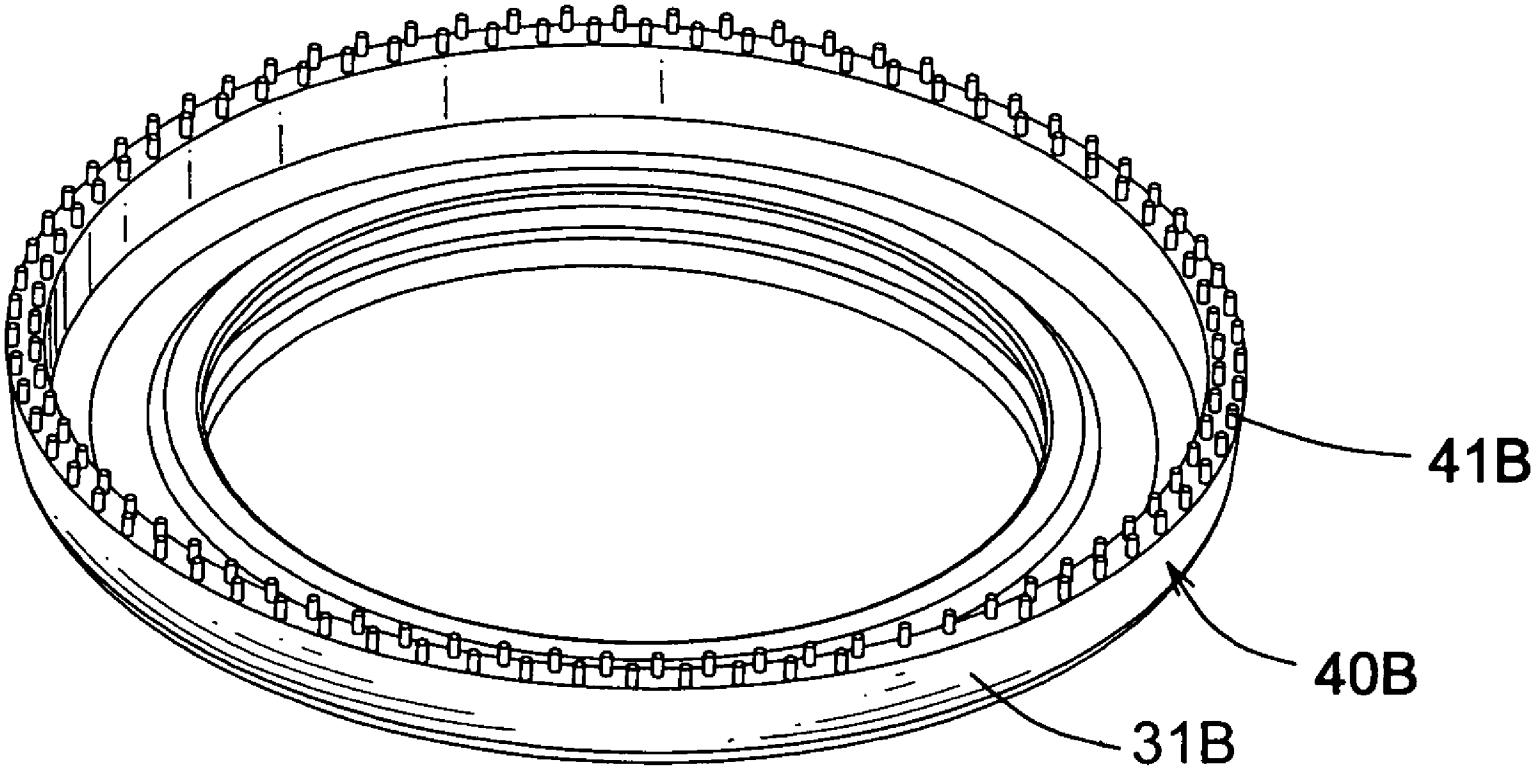
FIG. 6 is a perspective view of a dust shield in the second embodiment of the present invention in FIG. 5.

With reference to FIGS. 5-6, in a second embodiment of the present invention, the polishing machine has a similar structure as the first embodiment, except for the dust shield (30B). The dust shield (30B) also has a skirt (31B). Multiple brake units (40B) are directly mounted on a bottom circumference of the skirt (31B). Each brake unit (40B) has a brake pad (41B) abutting the polishing wheel (50).

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A polishing machine comprising:

a body;

a driving motor installed in the body, the driving motor having an eccentric shaft mounted at a bottom of the motor, and a polishing wheel connector mounted under the eccentric shaft;

a dust shield mounted on the body and outside the driving motor, the dust shield having, a skirt extending downward; and multiple sleeves formed in the skirt and each sleeve having a threaded hole;

multiple brake units mounted at a bottom of the dust shield and each brake unit having, a shank with an external thread and engaged in one of the threaded holes;

a head formed at a bottom of the shank; and a brake pad formed under the head; and a polishing wheel mounted under the dust shield and fastened to the polishing wheel connector by a threaded pin formed at a center of the polishing wheel, such that the polishing wheel contacts the brake pads of the multiple brake units.

2. The polishing machine as claimed in claim 1, wherein the brake pads are formed as brushes.

3. The polishing machine as claimed in claim 1, wherein the motor has a counterweight mounted between the eccentric shaft and the polishing wheel connector.

4. The polishing machine as claimed in claim 1, wherein the body has an inlet valve, a dust exhaust tube formed on the body, and a trigger mounted on the body to control the inlet valve; and the driving motor is a compressed air motor.

5. The polishing machine as claimed in claim 1, wherein the number of the brake units is twelve.

6. The polishing machine as claimed in claim 1, wherein the head of each brake unit is hexagonal.

* * * * *